US005489091A

United States Patent [19]

Greer et al.

[11] Patent Number: 5,489,091

[45] Date of Patent: Feb. 6, 1996

[54] METHOD AND APPARATUS FOR PRINTING AND COLLATING PACKETS OF NONREPEATING IMAGES ON A BASE WEB

[75] Inventors: Thomas W. Greer; James H. Meyers, both of Muskegon, Mich.

[73] Assignee: The Reliable Corporation of America, Muskegon, Mich.

[21] Appl. No.: 396,889

[22] Filed: Mar. 1, 1995

Related U.S. Application Data

[63] Continuation of Ser. No. 132,789, Oct. 7, 1993.

[51] Int. Cl.[6] ..... B41F 13/54; B41F 1/10; B42D 15/00

[52] U.S. Cl. ..... 270/1.1; 270/53; 270/58; 283/114; 101/76; 101/84; 101/226; 101/227; 101/490

[58] Field of Search ..... 270/1.1, 18, 19, 270/45, 12, 58; 101/76, 84, 226, 227, 490; 283/114, 903, 102, 42, 43

[56] References Cited

U.S. PATENT DOCUMENTS

| | | | |
|---|---|---|---|
| 3,304,862 | 2/1967 | Lawrence et al. . | |
| 3,822,876 | 7/1974 | Frain | 101/426 X |
| 3,921,519 | 11/1975 | Zimmer | 101/182 X |
| 3,974,766 | 8/1976 | Zimmer | 101/490 X |
| 3,998,446 | 12/1976 | Dent | 101/426 X |
| 4,256,037 | 3/1981 | Vertegaal . | |
| 4,270,774 | 6/1981 | Barnes | 273/269 X |
| 4,444,103 | 4/1984 | Cronin . | |
| 4,448,127 | 5/1984 | Frain | 270/1.1 X |
| 4,628,816 | 12/1986 | Six | 101/426 |
| 4,830,380 | 5/1989 | Six | 101/490 X |

OTHER PUBLICATIONS

"Automation Color–J Multi", *Graphic Industries, USA Inc.*

*Primary Examiner*—John E. Ryznic

*Attorney, Agent, or Firm*—Varnum, Riddering, Schmidt & Howlett

[57] ABSTRACT

An apparatus and method for the collated printing of a first set of images of a nonrepeating series and a second set of images. The collated printing provides for the complete printing of the nonrepeating series with respect to each of the images so that the combined images of the first and second series are collated in predetermined units or packets, preferably corresponding to the number of images in the repeating series. A first indicia for identifying the nonrepeating series and a second indicia for identifying the collated units can be printed on the combined images. Also, a strip of pressure-sensitive adhesive can be applied to the back of the combined images to form packets of the combined images and any desired quantity.

35 Claims, 8 Drawing Sheets

METHOD AND APPARATUS FOR PRINTING AND COLLATING PACKETS OF NONREPEATING IMAGES ON A BASE WEB

This is a continuation of application Ser. No. 08/132,789 filed Oct. 7, 1993.

BACKGROUND OF THE INVENTION

1. Field of the Invention

This invention relates to a printing apparatus and to a method of producing multiple sets of printed paper forms. In one of its aspects, the invention relates to paper having a nonrepeating series with sequentially repeating color borders, as for example, bingo forms.

2. Description of Related Art

There are many applications in which it is desirable to print multiple sets of sheets of paper having a series of images printed thereon and collating the paper so that a nonrepeating sequence of multiple images is created. An example of such an application is the printing of paper sheets into packets for use in playing the game BINGO.

The traditional bingo game is a game of chance in which players are given a sheet of paper with one or more bingo face matrices of five vertical columns and five horizontal rows. Each bingo face has one letter of the word BINGO located at the top of each vertical column with a 5×5 matrix of numbers below the letters. Five numbers, randomly selected between 1 and 15 are located beneath the letter B; five randomly selected numbers between 16 and 30 are located beneath the letter I; five randomly selected numbers between 31 and 45 are located beneath the letter N; five randomly selected numbers between 46 and 60 are located beneath the letter G; and five randomly selected numbers between 61 and 75 are located beneath the letter O. To start the game, a bingo caller randomly selects balls numbered 1 through 75, calling out the selected numbers. The bingo game proceeds by the caller successively, randomly selecting a bingo ball and calling out the appropriate number. Once a player has numbers on his or her game card which have been called and which create a predetermined configuration, this player yells "Bingo" and wins the game.

Traditionally, a single bingo face was printed on a thick durable paper or cardboard. These cards were known as "hard cards" with one face on each card. However, hard cards are falling out of favor for several reasons and are slowly being replaced by "paper" cards or bingo sheets. Bingo sheets are typically printed on newsprint or similar paper and have multiple bingo faces printed on each bingo sheet, typically eighteen, twenty-four or thirty-six. The bingo sheets are generally sold in packets containing multiple sheets to the bingo players as the bingo players enter the bingo hall. Each sheet of the packet is used for a separate bingo game during the evening. The player plays all of the bingo faces on the first sheet for the first game and marks the sheets with an ink marker bottle or ink "dauber" as the numbers are called. Once a winner is declared, the game is over and the player merely removes the top sheet from the packet and plays the next game on the next adjacent sheet. The marked sheet is discarded.

The packets are typically arranged so that each succeeding bingo sheet has a different border color or design so the bingo caller can readily determine if the players are playing the proper sheet for the current game. The different colors are also used to identify special games.

If two or more players obtain a winning "Bingo" at the same time, then the allocated prize will be divided up amongst all of the several winners. A bingo hall will generally be more successful if it awards larger prizes to the winning players. One way to avoid paying multiple small prizes is to ensure that only one person wins each game. A single winner for each game can be achieved by selling a series of game packets in which no bingo face of a particular combination of numbers appears on more than one sheet for each game. Therefore, each bingo sheet is preferably printed as a set or series of predetermined nonrepeating bingo faces.

A commonly used series is the 9000 series. A 9000 series indicates that the bingo sheets contain 9000 nonrepeating bingo faces. If each bingo sheet has 18 faces per sheet, a 9000 series will have 500 sheets providing for up to 500 players to play a single game before the faces are repeated. Other common series include the 1,500, 1,800, 3,000, 4,500, 6,000, 18,000 and 27,000 series. Bingo halls select an appropriate series for the anticipated number of players to ensure that there is only one winner per game.

Previous printing apparatuses and methods for creating nonrepeating series of bingo packets required that the bingo packets be formed from printing the entire series of bingo faces with a single border color and storing the entire colored series. After the desired number of different colored series are printed and stored, the bingo sheets are subsequently collated in packets and fastened together as a packet by a suitable adhesive or fastener. The independently printed series were typically collated by hand collating, mechanical sheet collating or roll collating. Hand collation requires the storing of the printed bingo sheets for each series and then hand-picking a sheet from each series to form a packet. Hand collation is labor intensive and adds significantly to the cost of the packets of bingo sheets.

Roll collating requires the bingo sheets to be left uncut on a paper roll after printing, each series being contained on a separate roll. The several rolls are then mounted onto a roll collator, which arranges the sheets of each roll in overlying registration. The sheets are then cut from the rolls, stacked and glue is applied to one edge of the stacks to form the packets. The roll collating method is disadvantageous because of the expense of keeping rolls of printed bingo sheets in stock, the expense of the collating machine necessary for collating the sheets and because the collating machine is limited as to the number of rolls it can accept, thus, limiting the number of sheets that can be collated per packet.

It is also known to sequentially print single face sheets on multiple paper rolls of different colors. The faces are stepped or indexed for each subsequent colored paper roll so that, when the multiple paper rolls are combined in overlying registration, the packets comprise single matrix bingo sheets with a predetermined color sequence. Such an apparatus is disclosed in the United States Patents to Barnes, U.S. Pat. No. 4,270,774, issued Jun. 2, 1981 and Dent, U.S. Pat. No. 3,998,446, issued Dec. 21, 1976.

SUMMARY OF THE INVENTION

The printing and collating method and apparatus according to the invention overcomes the problems of the prior art by creating a process whereby a complete series of nonrepeating images such as a series of bingo faces, can be combined with a second series of images, such as border colors, such that a series of sheets of paper are printed wherein no combination of the first series and the second series is repeated.

In the process according to the invention a first series of nonrepeating images are printed on the paper web. A first array of images is printed on the web adjacent the first series of nonrepeating images to create a first series of composite images on the web. After the first series of composite images is printed, a second series of the nonrepeating images is printed on the web. A second array of second images is printed on the web adjacent the second series of first nonrepeating images to create a second series of composite images printed on the web. One of the first nonrepeating images and the second images is indexed prior to creating the second series of composite images on the web so that no two composite images comprise the same combination of nonrepeating image and second image.

In another embodiment, said one of the first nonrepeating image and second image is indexed prior to creating the second series of composite images on the web only when the natural combination of second series of first nonrepeating images and first array of second images would result in a duplication of a previously printed composite image.

In another aspect of the invention, the invention is directed to a process for creating packets of multiple sheets of bingo paper comprising the steps of printing a first series of bingo faces on a web of paper in a first prescribed order. A plurality of border colors is printed on the paper web adjacent the first series of bingo faces in a second prescribed order to create a first series of composite images on the web. Next, a second series of bingo faces is printed on the web in the first prescribed order and a plurality of border colors is printed on the web adjacent the second series of bingo faces in a third prescribed order to create a second series of composite images on the web. Adhesive is selectively applied to portions of the web. The web is then cut into a plurality of sheets of paper, each sheet of paper having at least one composite image printed thereon. These sheets of paper are stacked in a fourth prescribed order such that the adhesive binds the sheets of stacked paper into packets of multiple sheets of bingo paper and the border colors are arranged in each packet in a fifth prescribed order, wherein no two sheets of paper in a common position in two packets of the paper have a common bingo face printed thereon.

BRIEF DESCRIPTION OF THE DRAWINGS

The invention will now be described with reference to the drawings wherein.

DESCRIPTION OF THE PREFERRED EMBODIMENTS

Figure 1:
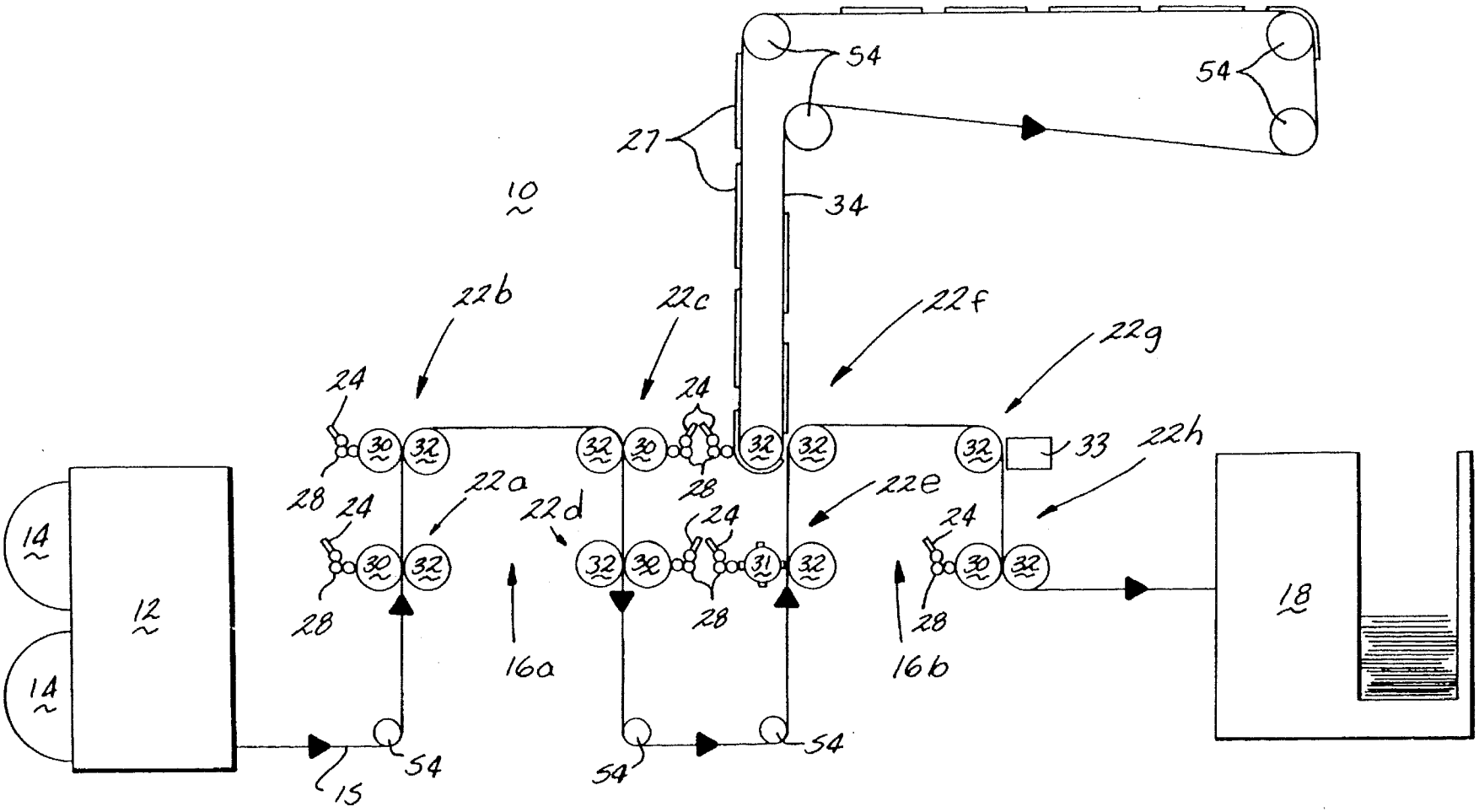
FIG. 1 is a schematic elevational view of a first embodiment of the printing and collating apparatus according to the invention.

FIG. 1 illustrates the printing and collating apparatus 10 according to the invention for the collated printing of paper sheets having a plurality of a nonrepeating images and a plurality of second images printed thereon to create a series of nonrepeating composite images. The printing and collating apparatus 10 also stacks the printed sheets so they can be automatically arranged and bonded in packets comprising multiple sheets.

The printing apparatus 10 comprises a splicer 12, which holds multiple rolls of paper 14 on which the series of the nonrepeating composite images are printed. Multiple printing presses 16*a*, 16*b* are sequentially aligned with and spaced from the splicer 12. The printing presses 16*a*, 16*b* are adapted to receive a web 15 of paper from one of the paper rolls 14 stored in the splicer 12. Although the printing apparatus 10 is shown having two presses 16*a*, 16*b*, the printing apparatus 10 can have one or more presses according to the invention. A sheeter 18, for cutting the web 15 into sheets and stacking the printed sheets, is located at the end of the printing apparatus 10 opposite the splicer 12.

Each of the printing presses 16*a*, 16*b* in FIG. 1 is illustrated as having four print units for a total of eight print units 22*a*–22*h* for printing images on the web. Although each printing press is shown as having four print units, each printing press can have one or more print units according to the invention. The print units 22*a*–22*h* print an image onto the paper web 15 as the web passes through the printing presses 16. The print units 22*a*–22*d* and 22*h* comprise a fluid well 24, a printing plate 26 (FIG. 2), fluid transfer rollers 28, and a plate cylinder 30. The printing plate 26 is generally mounted directly to the plate cylinder 30. The plate cylinder 30 of each print unit 22*a*–22*h* cooperates with one of several impression cylinders 32 of the printing presses 16*a*, 16*b* to print the composite images on the web 15.

The print unit 22*f* prints the several images of the nonrepeating series and comprises a printing plate belt 34 to which is mounted a plurality of first images or bingo face printing plates 27 in addition to fluid transfer rollers 28 and two impression cylinders 32. Print unit 22*f* does not use a plate cylinder 30 because the bingo face plates 27 are mounted to the belt 34. Print unit 22*e*, mounts a special type of plate cylinder, a numbering plate cylinder 31, for sequentially numbering the printed sheets with a serial number. Print unit 22*g* mounts an ink jet unit 33. The ink jet unit prints numerals or indicia, such as audit numbers described in more detail below, on the web 15.

The printing apparatus 10 can be configured to collate and print any size nonrepeating series of first images combined with any desired number of second images. However, for simplicity of description, the invention is described for four different second images (such as border colors) in combination with the desired size nonrepeating series of first images (such as a bingo series). In such a configuration, print units 22*a*–22*d* each apply one of the four color images A, B, C, and D, respectively, and print unit 22*f* applies the nonrepeating series of first images to the paper web 15. Print unit 22*e* prints the serial numbers, print unit 22*g* prints the audit numbers and print unit 22*h* applies adhesive to the paper web.

Typically, the fluid wells 24 are filled with ink. However, in accordance with the invention, one of the fluid wells 24, preferably for print unit 22*h*, is filled with adhesive that is selectively applied to the web 15 and ultimately bonds together the sheets cut from the web to form a packet of multiple sheets of paper.

For each print unit 22*a*–22*d*, 22*f* and 22*h*, the transfer rollers 28 are disposed between the fluid well 24 and the printing plate 26 so that the fluid is transferred from the fluid well 24 to the printing plate 26. Each plate cylinder 30 is disposed a predetermined distance from the impression cylinder 32 so that, when the printing plate 26 passes between the plate cylinder 30 and impression cylinder 32, the fluid on the surface of the printing plate 26 is transferred from the printing plate belt 34 to the paper web 15 as the printing plate 26 contacts the paper web 15. Similarly, the fluid transfer rollers 28 of the print unit 22*e* transfers fluid of the fluid well 24 to the numbering plate cylinder 31.

Figure 2:
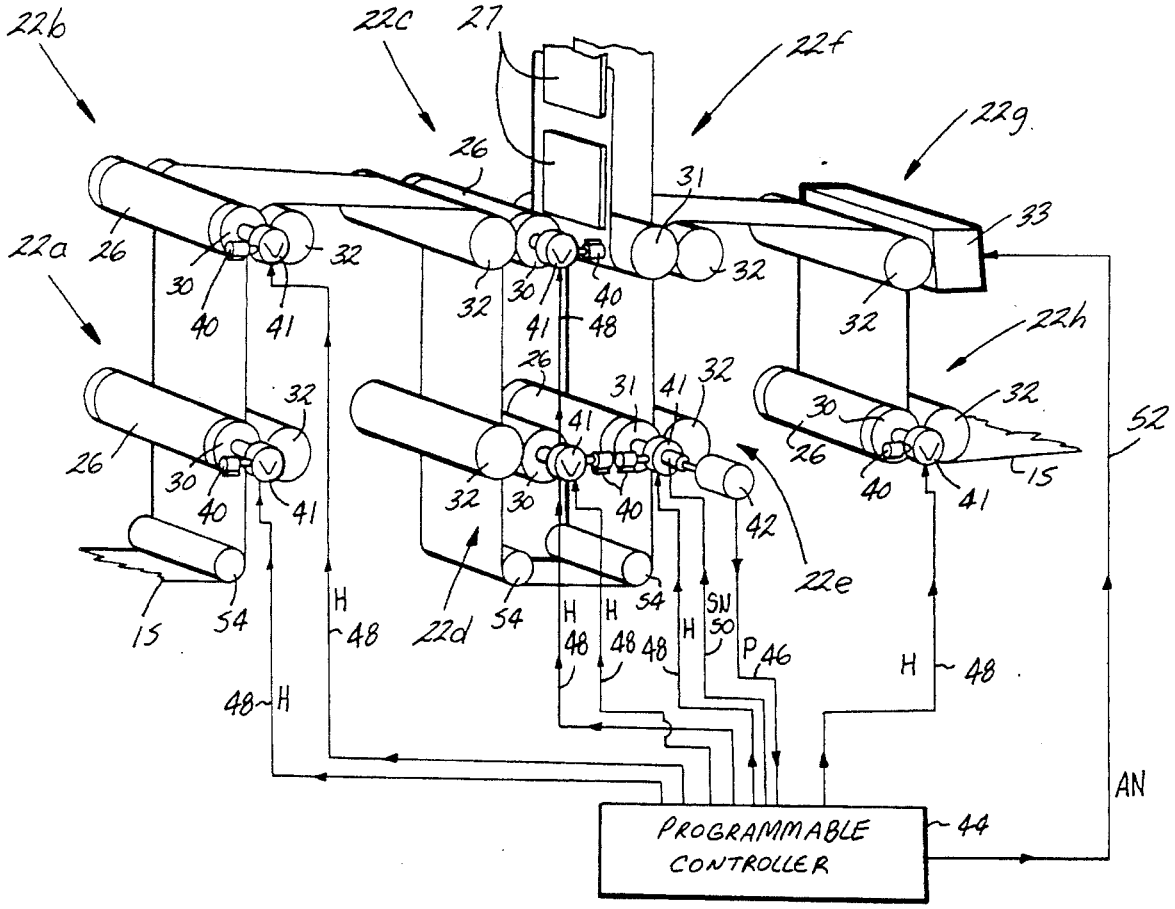
FIG. 2 is a schematic perspective view of the printing presses according to the invention.

Referring to FIG. 2 and in accordance with the invention, the plate cylinders 30 for print units 22*a*–22*d* and 22*h* are programmably controlled so that they are moved between a printing and a nonprinting position. In the printing position, the plate cylinder 30 and the printing plate 26 mounted thereon for the print units 22*a*–22*d* and 22*h* are positioned in contact with the paper web 15 to print on the paper web 15. In the nonprinting position, the plate cylinder 30 and printing plate 26 are a spaced distance from the paper web 15 so that no fluid is transferred from the respective printing plate 26 to the paper web 15.

The positions of plate cylinders 30 for print units 22*a*–22*d* and 22*h* are actuated between the printing and nonprinting positions by conventional hydraulic cylinders 40 having a hydraulic valve 41 mounted to each print unit 22. Preferably, the plate cylinder 30, fluid transfer roller 28 and fluid well 24 are mounted to one another as a single print unit. Therefore, as the hydraulic valve 41 is actuated between the printing and nonprinting positions, the hydraulic cylinder actuates the plate cylinder 30, fluid transfer rollers 28 and fluid well 24 relative to the impression cylinder 32.

Preferably, the plate cylinder 31 has a conventional encoder 42 mounted thereto for measuring the speed of rotation of the plate cylinder 31 and for counting the revolutions of the plate cylinder 31. Alternatively, the encoder can be mounted to one of the other plate cylinders 30, preferably one that is always in contact with the paper web 15.

The actuation of the print units 22 between the printing and nonprinting positions is controlled by a programmable controller 44, which controls the actuation of the hydraulic valve 41 and, thus, the actuation of the hydraulic cylinder 40 for each print unit 22. The encoder 42 and each hydraulic valve 41 are coupled to the programmable controller 44 by an encoder signal channel 46 and hydraulic valve signal channels 48, respectively. An impression roller position signal "P" is sent from the encoder 42 along encoder channel 46 to the programmable controller 44. The impression roller position signal P corresponds to the rotational position of the numbering plate cylinder 31 and is used to count the number of revolutions of the numbering plate cylinder 31.

For each print unit 22*a*–22*d* and 22*h*, a hydraulic valve actuation signal "H" is sent along hydraulic valve channels 48 from the programmable controller 44 to each of the hydraulic valves 41 to actuate the hydraulic valve 41 and move the hydraulic cylinder 40 thereby moving the print units 22*a*–22*d* and 22*h* between the printing and nonprinting positions.

Likewise, the numbering plate cylinder 31 and ink jet unit 33 are connected to the programmable controller 44 by a numbering roller signal channel 50 and an ink jet signal channel 52, respectively. A serial number signal "SN" is sent from the programmable controller 44 to the numbering plate cylinder 31 along numbering roller signal channel 50 and an audit number signal "AN" is sent from the programmable controller 44 to the ink jet unit 33 along the ink jet signal channel 52. The serial number signal SN indexes the serial number and is sent after all the images in the nonrepeating series have been printed. The audit number signal AN increments the audit number and is sent when the top sheet of each packet of a predetermined packet size is to be printed.

To understand the invention, it is helpful to describe the operation of the invention for a particular application. The particular application illustrated in FIG. 1 is for printing and collating multiple bingo sheets into packets comprising the combined printing of a series of four separate border colors with a nonrepeating series of 9000 bingo faces. Print units 22*a*–22*d* print the four border colors A–D. Print unit 22*e* prints a serial number on each bingo face uniquely identifying the series. Print unit 22*f* prints the nonrepeating bingo faces of the nonrepeating series. Print unit 22*g* prints the audit number on the top sheet of each packet. Print unit 22*h* applies a strip of pressure sensitive adhesive to the bingo sheet. In a 9000 series, each printing plate 26 of print unit 22*f* prints two sheets of 18 matrices. Thus, printing plate belt 34 mounts 250 printing plates 26.

Figure 3:
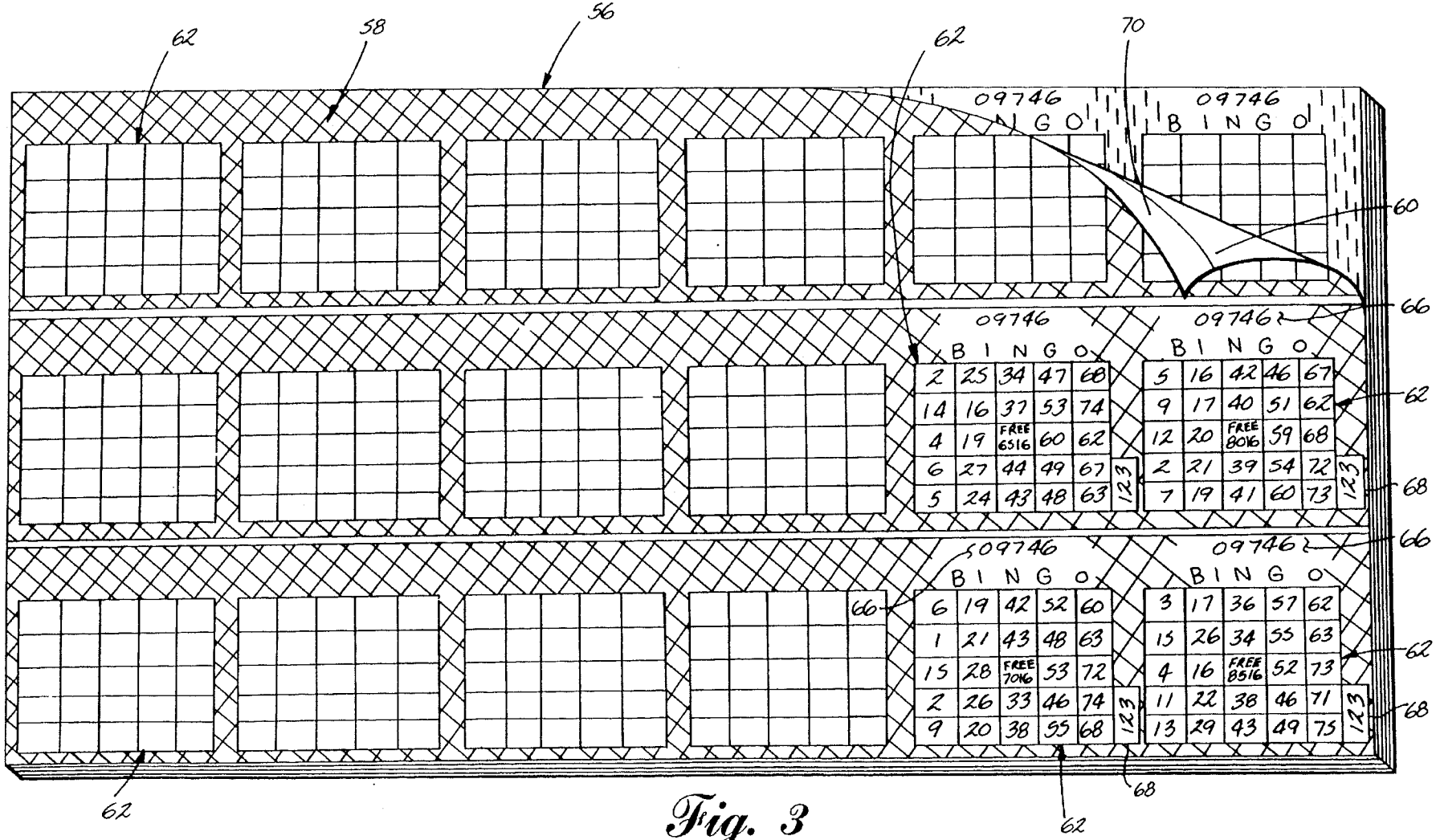
FIG. 3 is a plan view of a typical packet of multiple bingo sheets produced according to the invention.

A typical bingo packet of sheets 56 having the composite image produced according to the invention printed thereon is illustrated in FIG. 3. The bingo sheet has a front surface 58 and a back surface 60. A plurality of first images or bingo faces 62 arranged in rows and columns are printed on the front surface 58 of the bingo sheet 56. Each of these images in the particular series has a unique combination of bingo numbers. The illustrated bingo sheet is known as an "eighteen-on" because it has eighteen bingo faces 62 printed thereon. All of the packets produced in a set of composite images have the same order of colored bingo sheets 56.

A second image or printed border 64 of a predetermined color is printed such that the border surrounds each bingo face 62 creating a composite image. The composite image comprises the combination of the first and second images on each sheet. Typically, each complete printing of the series for all border colors is identified by a single serial number 66 which is printed on every sheet of the set, preferably above the word "BINGO." A bingo hall typically purchases the entire run of the series and uses the serial numbers as one way of auditing a bingo game. Every player in the hall should be playing packets having a prescribed serial number.

An audit number 68 is disposed at the lower right-hand edge of each bingo face of the top sheet of each packet of bingo sheets. The audit number 68 denotes the particular number of packet in the series. For example, a 9000 series comprises 500 packets of eighteen-on bingo sheets. Therefore, audit number 68, will be a number between 0 and 501, i.e. 1–500. However, any desired range of numbers can be used depending upon the desires of the bingo hall purchasing the set.

According to the invention, a strip of pressure-sensitive adhesive 70 is applied along an edge of the back surface 60 of the bingo sheet 56 to bond the bingo sheets 56 into packets, while providing for the easy separation of the bingo sheets 56 from the packet. In this embodiment, adhesive is applied to the web 15 according to what will become the top edge of the back surface 60 of each sheet in the packet excluding the bottom sheet of each packet. Advantageously, the adhesive 70 permits removing the bingo sheets 56 from the packet and bonding the sheets 56 to the table on which the bingo game is played. Alternatively, the adhesive could be applied to the top edge of the front surface 58 of each sheet except for the top sheet of each packet.

The problem encountered in the collated printing of multiple sets of a nonrepeating bingo series with sequentially varying border colors is easily explainable, but difficult to overcome. In printing any type of bingo series with the prior art printing apparatus and method, after one complete series is printed (a complete series is one complete revolution of the belt 34 having the bingo face printing plates) a fractional portion, equal to the inverse of the number of color borders, in this example one-fourth, of the faces for the nonrepeating series will be printed for each color border, i.e., plate 1 is color A, plate 2 is color B, plate 3 is color C and plate D is color 4. The subsequent printing of the complete series of bingo faces (a second revolution of the belt 34) with the same repeating sequence of colors will result in a second identical set of composite images, i.e. plate 1 will be border color A, plate 2 will be border color B, etc., unless the border colors are indexed with respect to the series of bingo faces so that each bingo plate of the second series of bingo faces has a different border color than the corresponding plate in the first series, i.e., all the plates are printed with each of the several border colors.

For example, for four border colors, one-fourth of the bingo faces of the series will be printed with one of the four border colors, i.e., plates 1, 5, 9, 13 etc. If the second run is identical to the first run, the second set of bingo faces will be identical to the first set, i.e., plates 1, 5, 9, 13 will be the first border color. In order to make the subsequent series different, the border colors must be indexed or changed for subsequent rotations of the printing plate belt if the number of plates on the belt would not naturally result is a different combination of bingo face printing plates and border colors.

In operation and in accordance with the invention, a web of paper 15 is drawn from the splicer 12 and threaded between the plate cylinder 30 and impression cylinder 32 of the printing presses 16 and into the sheeter 18. Guide rollers 54 are used through the printing apparatus to control and direct the movement of the paper web 15. If the paper roll runs out during a press run, the splicer 12 is used to connect subsequent paper rolls 14 to the web 15 without stopping the press run.

To obtain a complete series of nonrepeating bingo faces for each second image or border color, the series of bingo face printing plates 27 must be printed the same number times as there are border colors, i.e., four times for the four border color example. In the printing of the first series of the bingo face printing plates 27, the plate cylinders 30 for print units **22*a*–22*d* are actuated sequentially by the hydraulic cylinders 40, which are controlled by the preprogrammed programmable controller 44 to print the desired border color sequence; for example, colors A, B, C and D. After the border colors are sequentially printed, a serial number 66 is applied adjacent to the position where each bingo face will appear by the numbering plate cylinder 31. The bingo faces are then printed within the border for the complete bingo sheet by print unit 22*f*, which mounts the bingo face printing plates 27. Next, the audit number 68 is printed adjacent to each bingo face 62 of what will become the top sheet of each packet. Preferably, the audit number is printed near the lower right corner of the bingo face 62 by the ink jet unit 33. Finally, a strip of pressure sensitive adhesive is applied to the back surface 60 of the web corresponding to what will become a bingo sheet 56 by print unit 22*h*, which is controlled by the programmable controller 44**.

If the subsequent printing of the series would naturally result in a repetition or duplication of a previously printed combination of bingo faces and border colors then the sequence of border colors must be altered in the printing of the subsequent series. If repetition would naturally result after the first series is completed, the programmable controller 44 will alter the sequence of operation of the plate cylinder 30 for print units **22*a*–22*d* so that the first bingo face printing plate 27 on belt 34** will begin with a color other than color A, as in the first series. As described above, it is desired to print four complete series of composite images for each four color packet without any duplication of composite images. Therefore, it is necessary to index one of the sequence of border colors or bingo face printing plates to prevent duplication.

Figure 5:
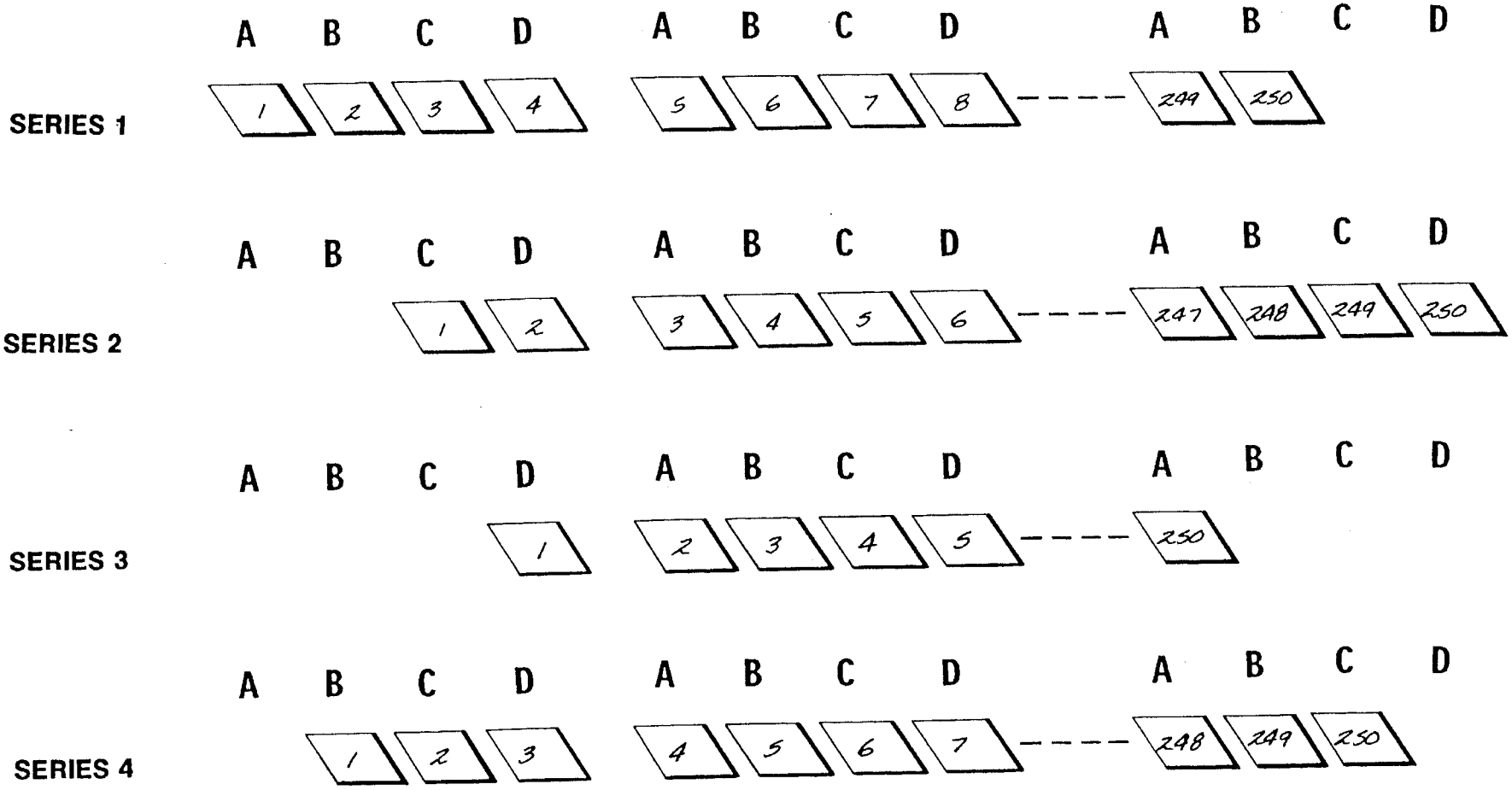
FIG. 5 is a schematic view illustrating the collating and bonding sequence of the sheets of paper printed according to the first embodiment of the invention.

In the first embodiment, the sequence of the border colors is altered by the controller when a naturally occurring repetition would result. In the example depicted in FIG. 5, the first naturally occurring repetition occurs in the third printing of the series of bingo faces. Therefore, the controller 44 instructs the print units **22*a*–22*d* to alter the printing sequence such that plate 1 is color D, plate 2 is Color A, plate 3 is color B, plate 4** is color C, etc.

At the completion of the printing of the third series, the naturally occurring sequence of composite images would result in plate 1 as color B, plate 2 as color C, plate 3 as color D and plate 4 as color A. This is the fourth and final combination of the border colors and bingo faces. Because duplication of a prior series of composite images has naturally been avoided, no indexing of one of the border colors and bingo faces is necessary.

The sheets of bingo paper which result from the process described above comprises each of the separate bingo face plates being combined only once with each border color. Therefore, if the sheets are combined into packets of four sheets of paper in the order ABCD, each of the 250 bingo face plates will appear once and only once for each colored sheet. If these packets are used in a bingo game, there will only be one winner for each game when each game is played only on one color sheet.

In a five border color, 250 bingo face printing plate configuration, the printing of the first series would create composite images of: plate 1 as color A, plate 2 as color B, plate 3 as color C, plate 4 as color D, plate 5 as color E, etc. Because the number of face plates 27 is divisible by the number of border colors, the four remaining printings of the series of composite images would be identical to the first printing absent indexing one of the border colors or bingo face plates. Therefore, on each subsequent printing of the series, one of the border colors or bingo face plates 27 must be indexed to prevent this natural repetition. In the first embodiment of the process and apparatus of the invention described above, the controller 44 would index the sequence of the border colors at the completion of the printing of each series to prevent repetition.

The apparatus and process according to the invention can be used for any number of border colors or printing plates, one must merely calculate when a naturally occurring repetition would result and then index one of the border colors or printing plates to prevent such a repetition.

Figure 4A:
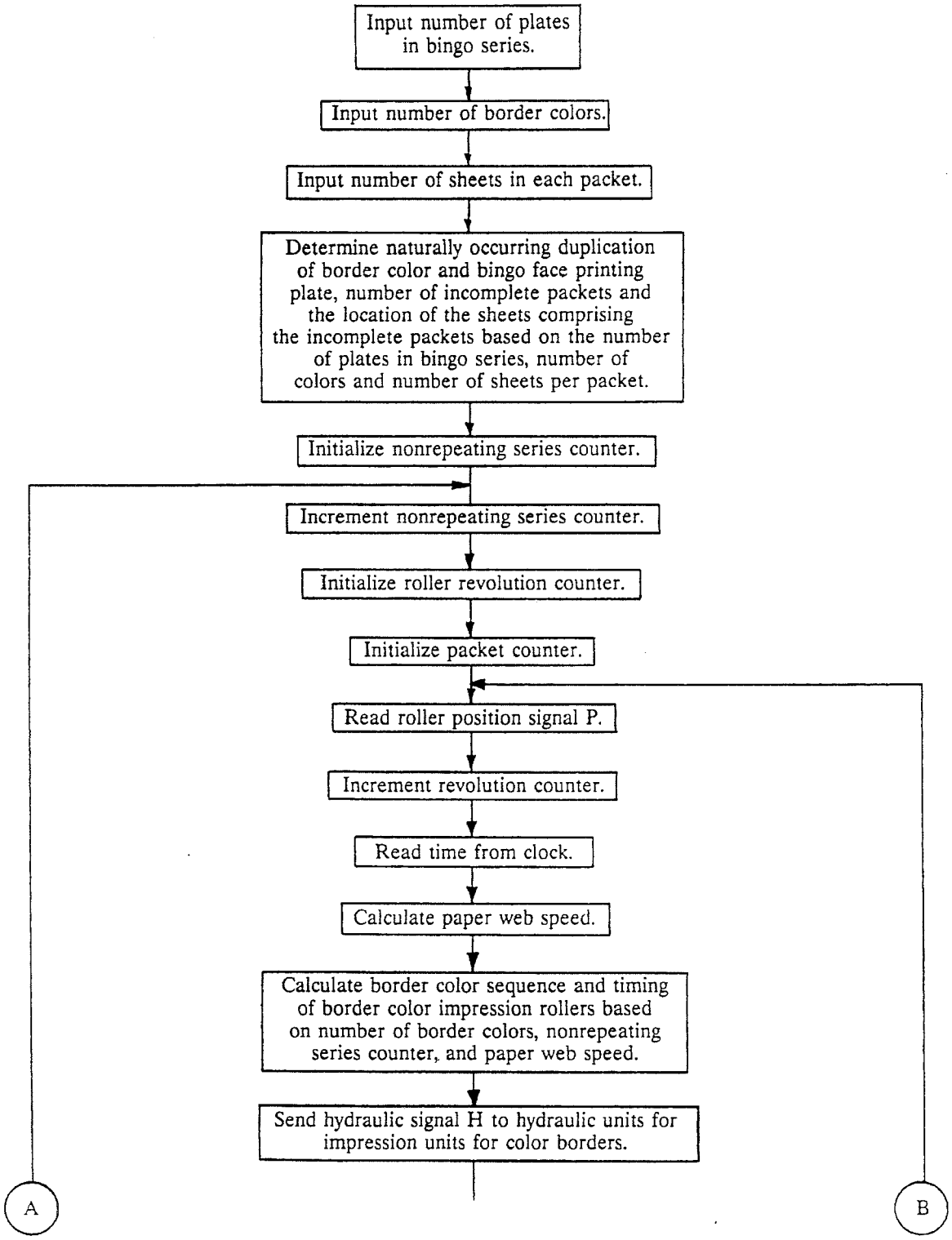
FIGS. 4A and 4B are a flow chart showing the steps of a programmable controller according to the invention.
Figure 4B:
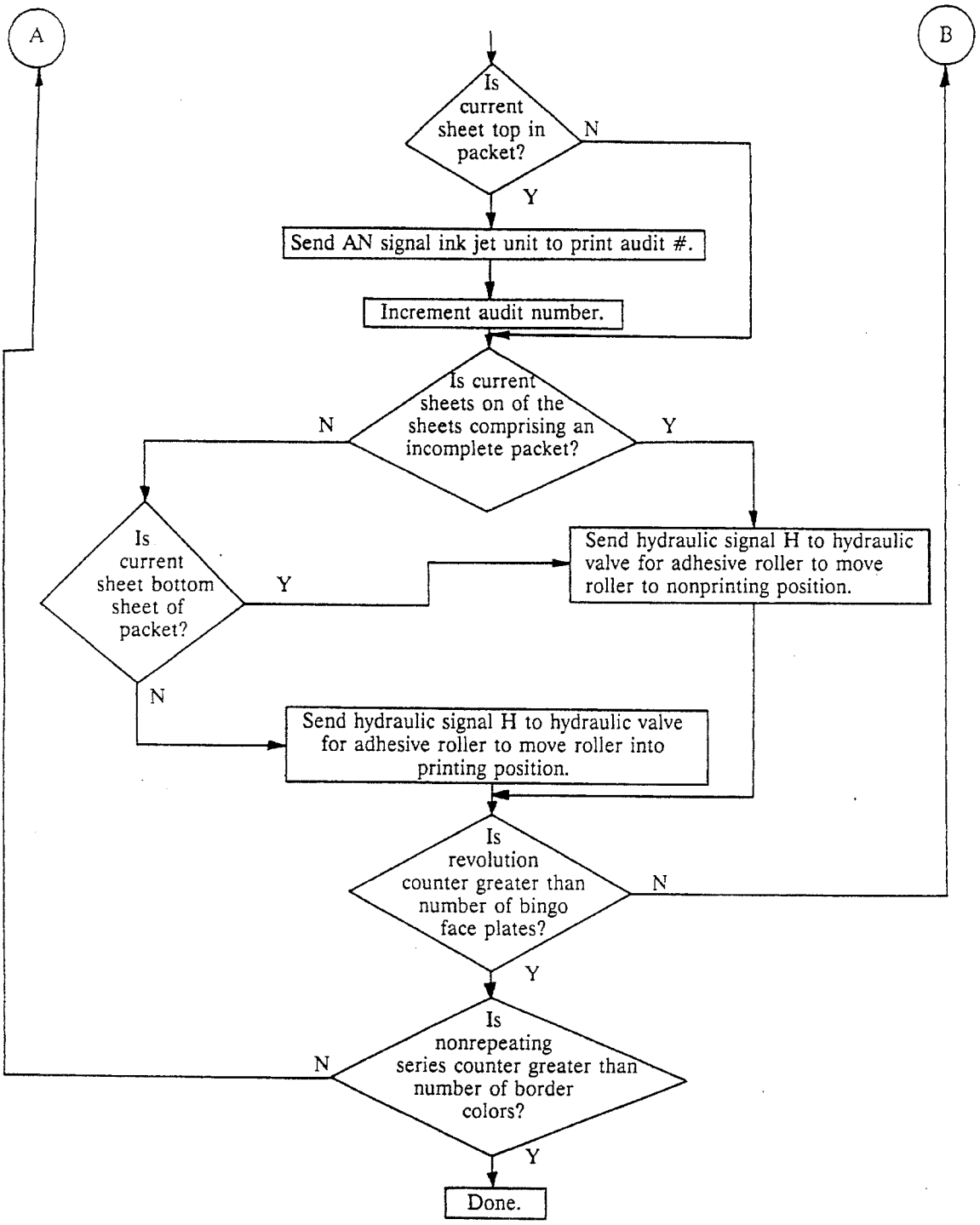

FIGS. 4A and 4B illustrate the program carried out by the programmable controller 44. Initially, before the printing of the bingo sheets is commenced, the number of plates in the bingo series, the number of border colors, and the number of sheets in each packet is input into the programmable controller 44. The programmable controller determines if and when a naturally occurring duplication of border color and bingo face printing plate would occur in subsequent printing of the series. The programmable controller 44 also determines the number of incomplete packets at the end of a printing of a series and the location of the sheets comprising the incomplete packets based on the input numbers of bingo series plates, border colors and sheets per packet.

During operation, the programmable controller 44 counts the number of times the series of nonrepeating bingo faces has been printed to ensure complete printing of the full set of composite images comprising each bingo face plate 27 in the series of nonrepeating bingo faces for each border color. After a full set is printed, the nonrepeating series counter is indexed by the programmable controller 44 for the printing of additional sets of composite images. The number of revolutions of the numbering plate cylinder 31 and the number of printed packets are also counted. The revolution counter and the packet counter are initialized prior to the printing of the bingo sheets.

The programmable controller 44 also reads the roller position signal P sent to the programmable controller 44 by the encoder 42 via the encoder signal channel 46. The revolution counter is increased whenever a signal P is received from the encoder. Simultaneously, the encoder stores the time the signal P was received. The encoder calculates the paper web speed based on the revolution counter and the difference between the time of subsequent revolutions. The programmable controller 44 calculates the border color sequence and timing of the border color impression rollers for print units 22*a*–22*d* based on the number of border colors, the nonrepeating series counter, and the paper web speed. An appropriate hydraulic signal H is sent to each of the hydraulic valves 41 for the print units 22*a*–22*d* for printing the borders color. The plate cylinder 30 for print units 22*a*–22*d* are then moved between the print and nonprinting positions in the desired sequence to ensure the sequential printing of the border colors.

After the timing sequence is determined, the programmable serial number and the nonrepeating bingo faces are printed on the current bingo sheet. The programmable controller then determines whether or not the audit number should be printed by checking the current sheet to determine if it is the top sheet in a packet. If it is the top sheet in a packet, then the programmable controller sends a signal AN to the ink jet unit along ink jet signal channel 52 to print the audit number. The audit number is then increased.

The programmable controller 44 then determines whether or not an adhesive strip should be applied to the back of the current sheet. The programmable controller 44 first determines if the current sheet is one of the sheets comprising an incomplete packet or is a bottom sheet of a packet. If the current sheet is part of an incomplete packet or the bottom sheet of a packet, the programmable controller 44 sends a hydraulic signal H to the hydraulic cylinder 40 for the plate cylinder 30 of the adhesive print unit 22*h* to move the plate cylinder 30 to the nonprinting position so that an adhesive strip will not be applied to the back of the bingo sheet. Otherwise, the programmable controller 44 sends a hydraulic signal H to the hydraulic cylinder 40 for the adhesive print unit 22*h* to move the plate cylinder 30 into the printing position to apply a strip of adhesive to the back surface 60 of the bingo sheet 56.

Once it is determined whether or not an adhesive strip should be applied to the current bingo sheet, the programmable controller 44 determines whether or not the current sheet represents the last plate in the nonrepeating series. If not, the roller position signal P is read once again and the process is repeated until a complete series of nonrepeating bingo faces is printed on the web. Once the full series of nonrepeating bingo faces is printed, the programmable controller 44 determines whether or not the nonrepeating bingo series has been printed a number of times equal to the number of border colors to ensure that a complete series is printed for each border color to create a complete set. If not, the nonrepeating series counter is increased and the revolution counter and packet counter are reinitialized. Next, the programmable controller 44 determines whether or not the subsequent printing of the series of bingo faces would result in repetition of a previously printed combination of bingo face printing plate and border color. If not, then the next series of border colors and bingo faces is printed. If a duplication were to occur, then the programmable controller alters the sequence of the border colors to prevent duplication. The process is then repeated until a complete series of nonrepeating bingo faces is printed for each border color. If it is desired to print multiple, complete sets of the bingo sheets, the process is repeated and the programmable controller 44 indexes the serial number by sending signal SN to the numbering plate cylinder 31 after each complete printing of the nonrepeating series for all border colors.

Preferably, each bingo face printing plate 27 prints two eighteen-on bingo sheets 56 at once, which can later be cut into separate sheets. While the preferred embodiment specifies cutting of the thirty-six-on sheet into two eighteen-on sheets, it will be understood that sheets of any size from one-on to thirty-six-on can be created from this printing plate 26. The printing plates 26 for the bingo faces are sequentially advanced by belt 34 for each bingo sheet. The paper web 15 on which the bingo sheets are now printed is then passed into the sheeter 18 where a knife cuts the paper web 15 into sheets and stacks the sheets on top one another.

For the majority of the sheets, the sheets are printed and stacked in groups comprised of sequential border colors. For example, in printing the first series, plates 1–4 are printed and stacked for colors A–D and plates 5–8 are printed and stacked for colors A–D. However, because the 250 plates comprising the 9000 series are not an integer multiple of the number of colors, there is an incomplete grouping at the end of the printing of the first series for plates 249 and 250 having colors A and B. For the printing of the second series, there is no incomplete packet. However, both the third and fourth printings of the series result in incomplete packets. It is clearly seen that the incomplete packets can later be combined to form complete groups or packets. Thus, after the completion of the fourth printing, the incomplete groups must be removed from the stacked sheets and hand collated to form the complete set of the four color 9000 series.

The locating and hand collating of the incomplete groups is made significantly easier by bonding the sheets of the complete groups into packets containing the same number of sheets as there are border colors during the printing of the sheets. To form packets of the complete groups during the collated printing, the plate cylinder 30*h* is moved between the printing and nonprinting positions to apply a strip of adhesive to the back of each bingo sheet of a packet, except for the last sheet in the packet. For example, a strip of adhesive is applied to the back surface of each bingo sheet (two per plate) for colors A–C and no adhesive is applied to the sheet on which the last color, D, is printed. Thus, as the sheets are stacked in the sheeter, one on top another, they are bonded in packets containing the same number of sheets as there are number of colors. To avoid bonding the incomplete packets, the programmable controller 44 moves the plate cylinder 30*h* to the nonprinting position for each sheet of an incomplete packet. The location of the sheets comprising the incomplete packet is determined by the programmable controller 44. The sheets of the incomplete packets are bonded together when they are hand collated. Thus, the invention greatly reduces the collation required for nonrepeating series having sequential border colors, while simultaneously bonding the sheets into useable packets.

The printing and collating apparatus, according to the invention is applicable for any amount of border colors because the programmable controller 44 can be programmed to accommodate any number of color borders and is only limited by the number of available plate cylinders. It will also be understood that the controller can be programmed to create packets of varying size and color arrangement depending upon the desires of the bingo hall.

The printing process of the first embodiment can be modified such that the sequence of border colors is indexed at the completion of the printing of each series of bingo face printing plates regardless of whether or not a naturally occurring duplication of composite images would result. For example, at the completion of the first series, the border color sequence could be indexed such that plate number 1 is printed with color B followed by C-D-A for the second series. In printing the third series, plate 1 would be color C and in the fourth series plate 1 would be color D.

Figure 6:
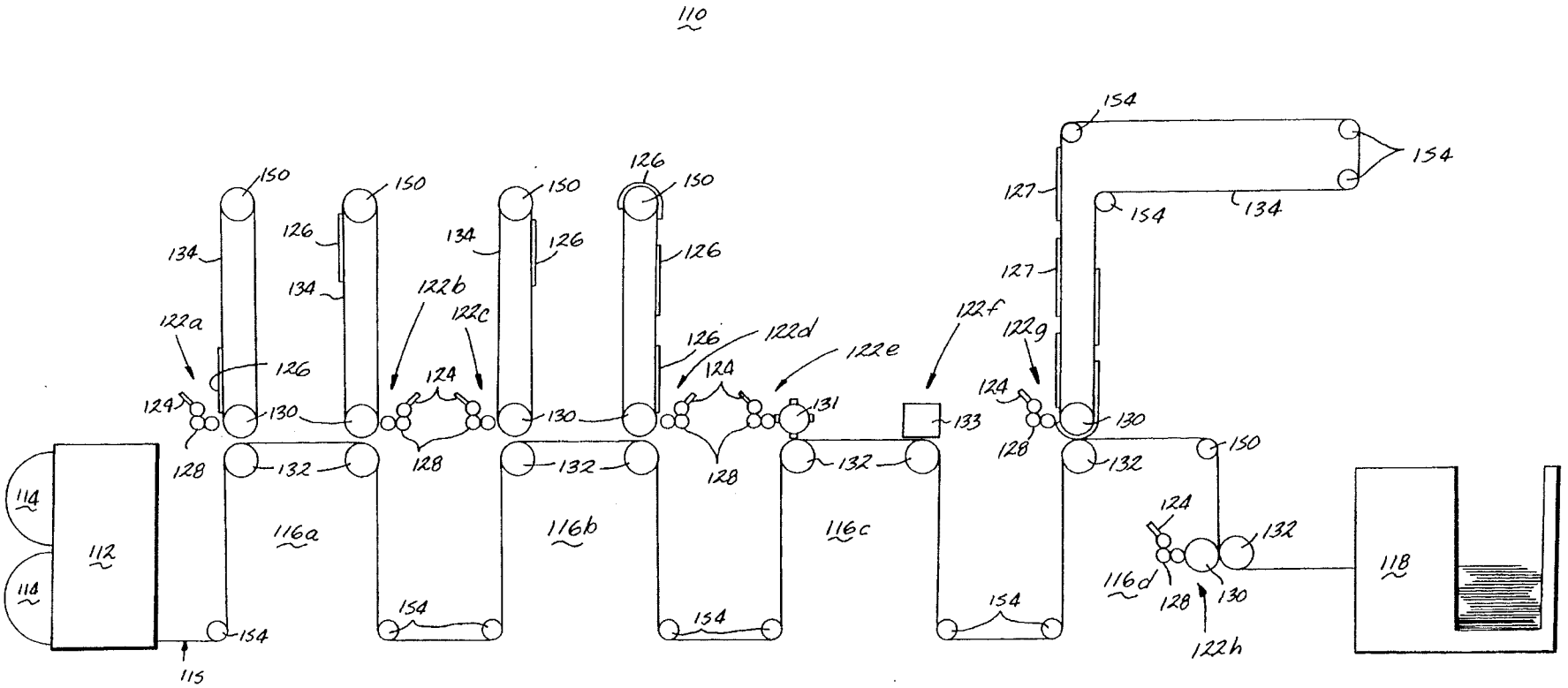
FIG. 6 is a schematic side view of the second embodiment of the printing and collating apparatus according to the invention.

FIG. 6 illustrates a second embodiment according to the invention. The second embodiment uses substantially the same printing apparatus as the first embodiment. Therefore, parts for the second embodiment identical to parts in the first embodiment will be increased by 100. The printing apparatus 110 comprises splicer 112, paper rolls 114, printing press 116 and sheeter 118. Each printing press 116 has print units 122 comprising a fluid well 124, printing plates 126, transfer rollers 128, an plate cylinder 130, and a impression cylinder 132.

Print unit **122*h* applies adhesive to bond the printed sheets to form a packet. Print unit 122*g* prints the nonrepeating series. Print unit 122*f* prints the audit numbers. Print unit 122*e* prints the serial numbers and print units 122*a*–122*d*** apply border colors A, B, C, and D, respectively.

Unlike the first embodiment, all of the print units **22*a*–22*d* and 22*f* have a printing plate belt 134. Print units 122*e*, 122*g* and 122*h* have a special numbering plate cylinder 131, ink jet unit 133, and an adhesive applicator, respectfully. The printing plate belts 134 mount printing plates 126 which print the border colors for the sheet. The spacing of the plates 126 on the several belts 134 is aligned to result in sequential printing of the images formed on the plates 126** on the paper web.

Because the second embodiment does not control the timing of the print units 122 by moving the impression rollers between printing and nonprinting positions, the collated printing of the second embodiment is accomplished by the physical spacing of the printing plates 126 for each print unit **122*h*. The collated printing is achieved by special spacing of the border color printing plates 126 in combination with the number of bingo face printing plates being selected such that the number of bingo face printing plates is not an integer multiple of the number of border colors. The forming of packets is achieved by the noninteger multiple number of printing plates and spacing of printing plates 126 for the adhesive applying print unit 122. For example, for packets containing four sheets, only three printing plates 126 are mounted to the printing plate belt 134 for the print unit 122*h***. The plates are spaced sequentially with a one plate gap between the first and third plates so that the bottom sheet in the packet does not receive a strip of adhesive.

The number of bingo face printing plates must not be an integer multiple of the number of border colors to index the border colors after a complete run through the series. Therefore, the bingo face printing plates will be indexed by at least one position with respect to the sequence of border colors, thereby preventing the repetition of a previously printed series of composite images. For example, a 9036 series can be used instead of a 9000 series to illustrate the second of a four color sequence. In a 9036 series, each printing plate 126 of print unit **122*f* prints two sheets of 18 matrices. Thus, printing plate belt 134 for print unit 122*g* mounts 251 printing plates 126**.

Figure 7:
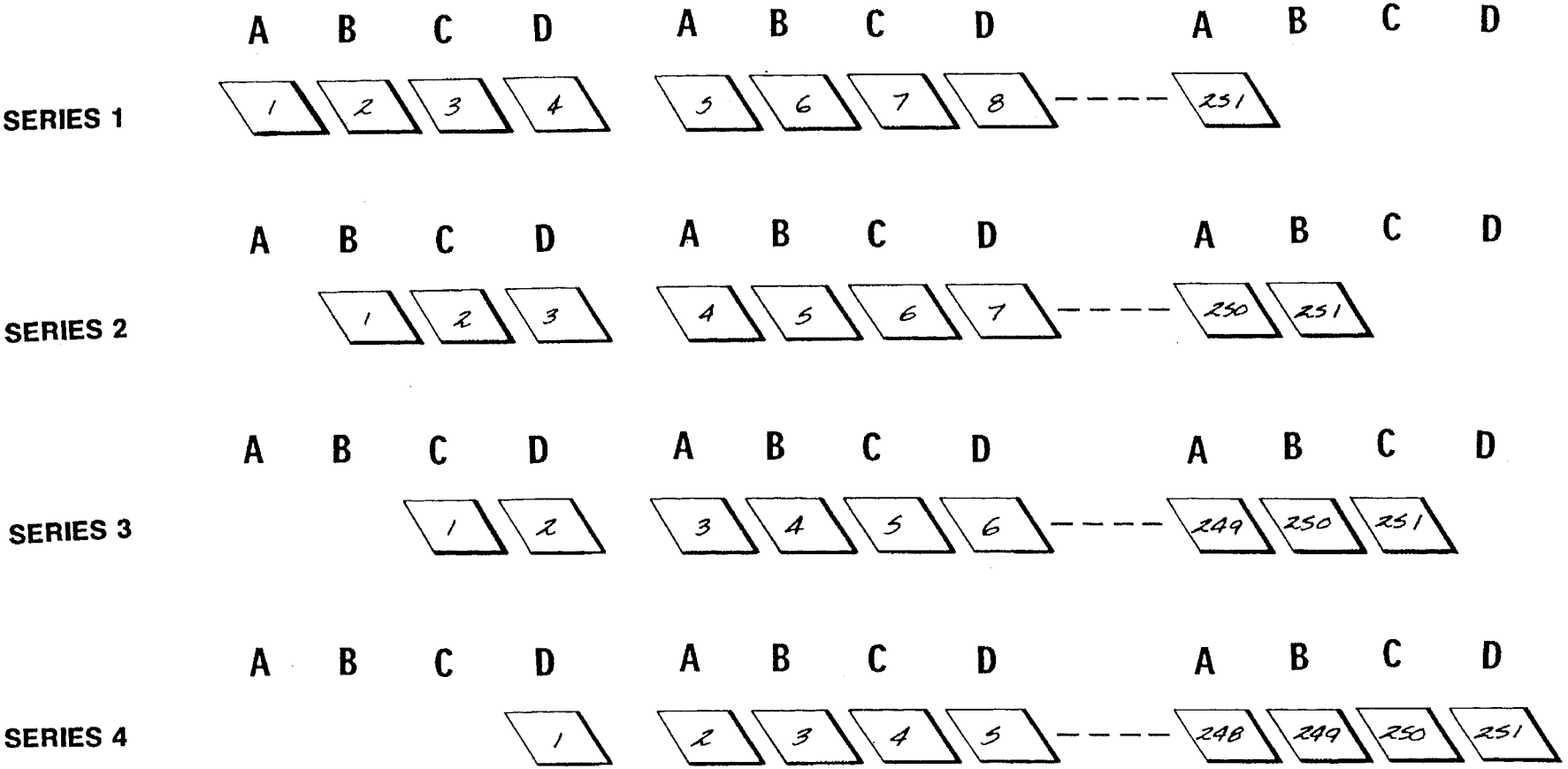
FIG. 7 is a schematic view illustrating the collating and bonding sequence of the sheets of paper printed according to the second embodiment of the invention.

Referring to FIG. 7, in operation, the second embodiment prints composite image bingo sheets 56 as disclosed in FIG. 3. For printing of the first series, as the paper web 115 passes through the print units **122*a*–122*d*, color borders 64 for colors A–D are sequentially applied. Print unit 122*e* then applies a serial number 66 to the bingo faces followed by printing of the bingo faces 62 by printing plates 127 of print unit 122*f*. An audit number 68 is applied to each bingo face of what will become the top sheet in each packet. The serial numbers 66 and audit numbers are controlled by a programmable controller 144 in the same manner as in the first embodiment. A strip of adhesive 152 is applied to the back surface 60 of all bingo sheets 56 for border colors B–D for packets of four border colors. The paper web 115 is then cut into sheets by sheeter 118. As the sheets are stacked in the sheeter 118**, the adhesive bonds the sheets into packets comprising the same number of sheets as border colors and in color sequence A–D.

For printing of the second series of composite images, the border color is automatically indexed with respect to the bingo plates 127 because the number of plates 127 is not an integer multiple of the number of border colors. The first plate in the nonrepeating sequence will automatically print on a different border color in the sequence. Therefore, as seen in FIG. 7, the second series prints border color sequence B, C, D, A. Likewise, the third series prints border color sequence C, D, A, B and the fourth series prints border color sequence D, A, B, C. Because the color border is automatically indexed, the second embodiment does not have any incomplete groups of border colors which must be hand collated. At the completion of four runs through the nonrepeating bingo matrices, each border color will be printed for a complete nonrepeating series and collated by border color sequence. The collated sheets will also be bonded in packets comprising the same number of sheets as border colors.

The method and apparatus of printing and collating packets of nonrepeating images on a base web according to the invention provides significant advantages over the prior art. Namely, packets of bingo paper can now be efficiently printed and collated which comprise the entire series of composite images of nonrepeating bingo faces for each color. The packets can be easily created through the selective application of adhesive and the proper cutting of the paper web. A producer of bingo paper can significantly reduce labor and capital expenses by printing and collating bingo packets according to the invention resulting in greater efficiency and profitability for the producer.

Reasonable variation and modification are possible within the spirit of the foregoing specification and drawings without departing from the scope of the invention.

The embodiments of the invention in which an exclusive property or privilege is claimed are defined as follows:

1. A process for producing a plurality of nonrepeating composite images on a web of paper comprising the steps of:

printing a first series of first nonrepeating images on the web utilizing a single printing roller;

printing a first array of second images on the web adjacent the first series of nonrepeating images to create a first set of composite images on the web, the printing of the first array being accomplished utilizing a plurality of printing rollers, each of the rollers having the same diameter;

printing a second series of the first nonrepeating images on the web utilizing said single printing roller, the second series being printed in tandem to the first series of composite images;

printing the first array of second images on the web adjacent the second series of first nonrepeating images to create a second series of composite images on the web, the printing of the first array being accomplished utilizing said plurality of printing rollers;

indexing one of the first nonrepeating image and second image prior to printing the second series of composite images on the web such that no two composite images in the first and second series of composite images comprise the same combination of first nonrepeating image and second image.

2. A process for producing a plurality of nonrepeating composite images on a web of paper according to claim 1 wherein said one of the first nonrepeating image and second image is indexed only when the natural combination of second series of first nonrepeating images and first array of second images would result in a duplication of a previously printed composite image.

3. A process for producing a plurality of nonrepeating composite images on a web of paper according to claim 1 and further comprising the step of cutting said web into sheets of paper, each sheet of paper having at least one composite image printed thereon.

4. A process for producing a plurality of nonrepeating composite images on a web of paper according to claim 3 and further comprising the step of stacking said sheets of paper into multiple packets in a first prescribed order such that the second images are arranged in each packet in a second prescribed order.

5. A process for producing a plurality of nonrepeating composite images on a web of paper according to claim 4 and further comprising the step of selectively applying adhesive to portions of the web prior to the steps of cutting and stacking the sheets of paper into packets such that no two sheets of paper in a common position in two packets of paper have a common composite image printed thereon.

6. A process for producing a plurality of nonrepeating composite images on a web of paper according to claim 5 wherein the adhesive comprises a pressure sensitive adhesive.

7. A process for producing a plurality of nonrepeating composite images on a web of paper according to claim 5 wherein the adhesive is applied to the web immediately adjacent to what will become a top edge of each sheet of paper in the packet except for one of a top sheet of paper in the stack and a bottom sheet of paper in the stack.

8. A process for producing a plurality of nonrepeating composite images on a web of paper according to claim 7 wherein the adhesive is applied to what will become the bottom surface of each sheet of paper in the packet except for the bottom sheet of paper in the packet.

9. A process for producing a plurality of nonrepeating composite images on a web of paper according to claim 7 wherein the adhesive is applied to what will become the top surface of each sheet of paper in the packet except for the top sheet of paper in the packet.

10. A process for producing a plurality of nonrepeating composite images on a web of paper according to claim 4 and further comprising the step of printing an audit number on the web on what will become a top sheet of each packet once the web has been cut and stacked wherein the audit number uniquely identifies each packet of the series of composite images.

11. A process for producing a plurality of nonrepeating composite images on a web of paper according to claim 10 and further comprising the step of printing a serial number on the web on what will become each sheet of paper having composite images printed thereon, wherein the serial number is common for all sheets of paper in the series and uniquely identifies the series.

12. A process for producing a plurality of nonrepeating composite images on a web of paper according to claim 1 further comprising the steps printing a third series of the first nonrepeating images on the web utilizing the single printing roller;

printing the first array of second images on the web adjacent the third series of nonrepeating images to create a third series of composite images on the web, the first array being printed utilizing said plurality of printing rollers;

indexing one of the first nonrepeating image and second image prior to printing the third series of composite images on the web such that no two composite images in the first, second and third series of composite images comprises the same combination of first nonrepeating image and second image.

13. A process for producing a plurality of nonrepeating composite images on a web of paper according to claim 12 wherein said one of the first nonrepeating image and second image is indexed only when the natural combination of third series of first nonrepeating images and first array of second images would result in a duplication of a previously printed composite image.

14. A process for producing a plurality of nonrepeating composite images on a web of paper according to claim 1 comprising the steps of;

printing a prescribed number of series of first nonrepeating images on the web, the prescribed number being equal to the number of the second images in each array of second images; and indexing one of the first nonrepeating image and second image prior to repeating the printing of the set of first nonrepeating images.

15. A process for producing packets of multiple sheets of bingo paper comprising the steps of;

printing a first series of bingo faces on the web in a first prescribed order;

printing a plurality of border colors on said web adjacent the first set of bingo faces in a second prescribed order to create a first series of composite images on the web;

printing a second series of bingo faces on the web in the first prescribed order in tandem with the first series of composite images;

printing each of said plurality of border colors on said web adjacent the second series of bingo faces in a third prescribed order to create a second set of composite images on the web different from the first set of composite images;

wherein the first and second composite images comprise a non-repeating series of combinations of bingo faces and border colors.

16. A process for producing packets of multiple sheets of bingo paper according to claim 15 wherein the third prescribed order of plurality of border color is different from the second prescribed order of plurality of border colors when the second series of composite images printed on the web would contain a duplication of one of the first composite images previously printed on the web.

17. A process for producing packets of multiple sheets of bingo paper according to claim 15 and further comprising the step of cutting said web into sheets of bingo paper, each sheet of paper having at least one composite image printed thereon.

18. A process for producing packets of multiple sheets of bingo paper according to claim 17 and further comprising the step of stacking said sheets of paper into multiple packets in a fourth prescribed order such that the border colors are arranged in each packet in a fifth prescribed order.

19. A process for producing packets of multiple sheets of bingo paper according to claim 18 and further comprising the step of selectively applying adhesive to portions of the web prior to the steps of cutting and stacking the sheets of bingo paper into packets wherein no two sheets of paper in a common position in two packets of paper have a common bingo face printed thereon.

20. A process for producing packets of multiple sheets of bingo paper according to claim 19 wherein the adhesive comprises a pressure sensitive adhesive.

21. A process for producing packets of multiple sheets of bingo paper according to claim 19 wherein the adhesive is applied to the web immediately adjacent to what will become a top edge of each sheet of paper in the packet except for one of a top sheet of paper in the packet and a bottom sheet of paper in the packet.

22. A process for producing packets of multiple sheets of bingo paper according to claim 21 wherein the adhesive is applied to what will become the bottom surface of each sheet of paper in the packet except for the bottom sheet of paper in the packet.

23. A process for producing packets of multiple sheets of bingo paper according to claim 21 wherein the adhesive is applied to what will become the top surface of each sheet of paper in the packet except for the top sheet of paper in the packet.

24. A process for producing packets of multiple sheets of bingo paper according to claim 19 and further comprising the step of printing an audit number on the web on what will become a top sheet of each packet once the web has been cut and stacked wherein the audit number uniquely identifies each packet of the series.

25. A process for producing packets of multiple sheets of bingo paper according to claim 19 and further comprising the step of printing a serial number on the web on what will become each sheet of paper having composite images printed thereon, wherein the serial number is common for all sheets of paper in the series.

26. A process for producing packets of multiple sheets of bingo paper according to claim 15 and further comprising the steps of;

printing a third series of bingo faces on the web in the first prescribed order in tandem with the second set of composite images; and printing the plurality of border colors on the web adjacent the third set of bingo faces on the web in a sixth prescribed order to create a third set of composite images on the web different from the first and second sets of composite images.

27. A process for producing packets of multiple sheets of bingo paper according to claim 26 wherein said sixth prescribed order of the plurality of border colors is different from the second and third prescribed orders of border colors when the third series of composite images printed on the web would contain a duplication of a previously printed composite image.

28. A process for producing packets of multiple sheets of bingo paper comprising the steps of;

printing a first series of a nonrepeating bingo faces on a web of paper in a first prescribed order;

printing a plurality of border colors on the web adjacent the first set of bingo faces in a second prescribed order to create a first series of nonrepeating composite images on the web;

printing a second series of nonrepeating bingo faces on the web in the first prescribed order in tandem with the first series of composite images;

printing the plurality of border colors on the web adjacent the second set of bingo faces in a third prescribed order to create a second set of nonrepeating composite images on the web;

selectively applying adhesive to portions of the web;

cutting the web into a plurality of sheets of paper, each sheet of paper having at least one composite image printed thereon;

stacking said sheets of paper in a fourth prescribed order such that the adhesive binds the sheets of paper into packets of multiple sheets of bingo paper and the border colors are arranged in each packet in a fifth prescribed order;

wherein no two sheets of paper in a common position in two packets of paper have a common composite image printed thereon.

29. A process for producing packets of multiple sheets of bingo paper according to claim 28 and further comprising the steps of;

printing a third series of nonrepeating bingo faces on the web in the first prescribed order in tandem with the second series of composite images; and printing the plurality of border colors on the web adjacent the third series of bingo faces on the web in a sixth prescribed order to create a third set of composite images on the web.

30. A process for producing packets of multiple sheets of bingo paper according to claim 28 and further comprising the step of printing an audit number on the web on what will become the top sheet of each packet once the web has been cut and stacked wherein the audit number uniquely identifies each packet of the series.

31. A process for producing packets of multiple sheets of bingo paper according to claim 30 and further comprising the step of printing a serial number on the web on what will become each sheet of paper having composite images printed thereon, wherein the serial number is common for all sheets of paper in the series and uniquely identifies the series.

32. A process for producing packets of multiple sheets of bingo paper according to claim 28 wherein the adhesive is applied to the web immediately adjacent to what will become a top edge of each sheet of paper in the packet except for one of a top sheet of paper in the packet and a bottom sheet of paper in the packet.

33. A process for producing packets of multiple sheets of bingo paper according to claim 32 wherein the adhesive is applied to what will become the bottom surface of each sheet of paper in the packet except for the bottom sheet of paper in the packet.

34. A process for producing packets of multiple sheets of bingo paper according to claim 32 wherein the adhesive is applied to what will become the top surface of each sheet of paper in the packet except for the top sheet of paper in the packet.

35. A process for producing packets of multiple sheets of bingo paper according to claim 28 wherein the adhesive comprises a pressure sensitive adhesive.

* * * * *

UNITED STATES PATENT AND TRADEMARK OFFICE

CERTIFICATE OF CORRECTION

PATENT NO. : 5,489,091

DATED : February 6, 1996

INVENTOR(S) : Thomas W. Greer et al.

It is certified that error appears in the above-indentified patent and that said Letters Patent is hereby corrected as shown below:

Column 14, claim 12, line 3:
After "steps" insert --of:--.

Signed and Sealed this

Fourteenth Day of May, 1996

Bruce Lehman

*Attest:*

BRUCE LEHMAN

*Attesting Officer*

*Commissioner of Patents and Trademarks*